US007476483B2

(12) United States Patent
Kamikoriyama et al.

(10) Patent No.: US 7,476,483 B2
(45) Date of Patent: Jan. 13, 2009

(54) CARRIER FOR ELECTROPHOTOGRAPHIC DEVELOPER AND TWO-COMPONENT ELECTROPHOTOGRAPHIC DEVELOPER

(75) Inventors: Yoichi Kamikoriyama, Ageo (JP); Kenji Suzuoka, Ageo (JP); Takashi Nakashima, Ageo (JP); Kazuya Kinoshita, Ageo (JP); Yuji Sato, Kashiwa (JP); Hiromichi Kobayashi, Kashiwa (JP); Takeshi Gondo, Kashiwa (JP); Takashi Hikichi, Kashiwa (JP)

(73) Assignees: Mitsui Mining and Smelting Co., Ltd., Tokyo (JP); Powdertech Co., Ltd., Chiba (JP)

( * ) Notice: Subject to any disclaimer, the term of this patent is extended or adjusted under 35 U.S.C. 154(b) by 458 days.

(21) Appl. No.: 11/296,630

(22) Filed: Dec. 7, 2005

(65) Prior Publication Data

US 2006/0121386 A1 Jun. 8, 2006

(30) Foreign Application Priority Data

Dec. 7, 2004 (JP) ..... 2004-354630

(51) Int. Cl.
*G03G 9/107* (2006.01)

(52) U.S. Cl. ..... 430/111.32; 430/111.35

(58) Field of Classification Search ..... 430/111.32, 430/111.35
See application file for complete search history.

(56) References Cited

U.S. PATENT DOCUMENTS

2004/0248015 A1* 12/2004 Kamikoriyama et al. ..... 430/4

FOREIGN PATENT DOCUMENTS

JP 5-113696 A 5/1993
JP 2000-199985 A 7/2000

* cited by examiner

*Primary Examiner*—Hoa V Le
(74) *Attorney, Agent, or Firm*—The Webb Law Firm

(57) ABSTRACT

A carrier for electrophotographic developer comprises a resin carrier core comprising a binder resin and magnetic powder dispersed in the binder resin, and a coating layer comprising a coating resin on a surface of the core, the binder resin being a silicone resin obtained by curing of a polysiloxane compound (A) having an epoxy group and a polysiloxane compound (B) having a group capable of reacting with the epoxy group, due to a ring-opening addition reaction; the binder resin containing a functional group which is an epoxy group and/or a group capable of reacting with an epoxy group; the coating resin containing a functional group capable of reacting with the functional group of the binder resin; the functional group of the coating resin and the function group of the binder resin forming a chemical bond.

25 Claims, 3 Drawing Sheets

凹 : Functional group (s)

凸 : Functional group (c)

凹 : Functional group (s)

凸 : Functional group (c)

凹 : Functional group reactable with functional group (凸)

凸 : Functional group reactable with functional group (凹)

CARRIER FOR ELECTROPHOTOGRAPHIC DEVELOPER AND TWO-COMPONENT ELECTROPHOTOGRAPHIC DEVELOPER

TECHNICAL FIELD

The present invention relates to a magnetic powder-dispersed carrier for electrophotographic developer and a two-component electrophotographic developer that are used for development of an electrostatic latent image formed by electrophotography or electrostatic printing.

BACKGROUND OF THE INVENTION

Electrophotographic development is a method wherein an image is developed by causing toner particles present in a developer to adhere to an electrostatic latent image on a photosensitive material. The developers utilized in this method are classified into two-component developers composed of toner particles and carrier particles, and one-component developers consisting of toner particles.

The cascade development process is a traditional method in which the two-component developers composed of toner particles and carrier particles are used, but the magnetic brush development process involving a magnet roller is currently mainstream.

The carrier particles in the two-component developers give a desired electric charge to the toner particles when they are stirred together in a developing box filled with the developer, and further work as a carrier substance that transports the charged toner particles onto the surface of a photosensitive material to form a toner image on the photosensitive material. The carrier particles which remain on a magnet-having developing roller are reintroduced into the developing box, and the particles are mixed and stirred with new toner particles. In this way, the carrier particles are used repeatedly for a certain period.

The two-component developers differ from the one-component types in that the carrier particles are mixed and stirred with the toner particles to charge and transport the toner particles, permitting good controllability in designing the developer. Therefore, the two-component developers are suited for use in full-color printers requiring high image quality and high-speed printers requiring image-maintaining reliability and durability.

It is necessary that the two-component developers show desired levels of image properties such as image density, blushing, white spots, tone properties and resolving power from an initial stage and that the properties are stably maintained without change throughout long term use. In order that these properties are maintained stably, the carrier particles contained in the two-component developers must have stable properties.

Iron powder carriers such as oxide-coated or resin-coated iron powders are conventional carrier particles in the two-component developers. The iron powder carriers possess high magnetization and high conductivity to provide advantageous easy and highly reproducible development of solid images.

The iron powder carriers, however, have a heavy own weight and its magnetization is too high, so that when they are stirred and mixed with toner particles in a developing box, the toner is more likely to adhere to the surface of the iron powder carrier, that is, toner-spent is apt to occur. The toner-spent will lead to decrease of the effective carrier surface area and lowering of the capability of triboelectrically charging the toner particles.

With regard to the resin-coated iron powder carriers, the surface resin is often separated by stress during long-time use and consequently the core (iron powder) having high conductivity and low dielectric breakdown voltage is exposed to induce leakage of electric charge. The leakage of electric charge breaks an electrostatic latent image formed on a photosensitive material to cause brush traces and the like in solid images, and therefore development of uniform images is difficult. Such inferior durability has been a problem of the resin-coated iron powder particles. From the above reasons, the iron powder carriers including the oxide-coated iron powder and the resin-coated iron powder have been avoided.

As a substitute for the iron powder carriers, there have recently been proposed magnetic powder-dispersed resin-binder carriers in which magnetic powder is dispersed in a binder resin. The magnetic powder-dispersed resin-binder carriers have been insufficient in durability in long-term use. JP-A-2000-199985 proposes a resin-coated magnetic carrier that includes magnetic powder whose surface is lipophilized to give a functional group, wherein the functional group on the magnetic powder surface is chemically bonded with a functional group of the coating resin. This resin-coated magnetic carrier has a problem that the carrier core is inferior in mechanical strength because the binder resin is not a silicone resin synthesized by ring-opening addition reaction free of by-products. Further, the chemical bonds between the functional groups of the magnetic powder surface and coating resin as illustrated in FIG. 3 cannot achieve a sufficient bond strength between the core and the coating resin layer because there is only a small number of functional groups exposed on the core surface and consequently there are few chemical bonds with the functional groups of the coating resin. Accordingly, the coating durability has been unable to meet the recent difficult requirements.

Meanwhile, magnetic powder-dispersed carrier cores that are composed of binder resins such as phenolic resin possessing higher surface free energy than silicone resin have another problem that if the carrier core has an exposed part, it is easily contaminated with the toner or the like during printing to cause defective images.

Further, when the carrier core is formed of a binder resin such as silicone resin having low surface energy and the coating resin has no functional groups enabling chemical bond with the core-forming binder resin, the resin coating step tends to result in poor adhesion of the coating layer because of few chemical bonds. Thus, it has been difficult to obtain resin-coated carriers based on magnetic powder-dispersed binder resin with sufficient coating durability.

Accordingly, there has been a need for a resin-coated carrier based on magnetic powder-dispersed binder resin that has high bond strength between the core and the coating resin layer and is free of separation of the coating resin layer from the core.

JP-A-05-113696 discloses magnetic particles in which a polymer forming a core and a polymer forming a coating layer are covalently bonded. These polymers are each formed from a radically polymerizable monomer, and therefore the production steps are intricate and the polymerization must be performed in an inactive atmosphere, causing industrial disadvantages. Furthermore, when the magnetic powder is exposed on the surface of the resin-coated carrier, the magnetic powder is apt to be released and the carrier particles tend to be contaminated with the toner, leading to a damaged drum and defective images such as blushing.

Moreover, the coating resins are limited to resins formed from radically polymerizable monomers, which narrows the degree of designing freedom to satisfy carrier properties required and makes it difficult to cope with varied requirements. The magnetic particles of JP-A-05-113696 differ from the carrier for electrophotographic developer of the present invention in that both the core and the coating layer of JP-A-05-113696 contain magnetic powder.

It is an object of the present invention to provide a carrier for electrophotographic developer that comprises a carrier core comprising a binder resin and magnetic powder dispersed in the resin, and a coating resin layer formed on the core surface, wherein the carrier is free of release of the magnetic powder, has high mechanical strength and good environmental stability, can prevent the toner-spent, possesses excellent flowability and high bond strength between the core and coating resin layer, and thereby achieves superior durability and toner-charging capability.

It is another object of the invention to provide a two-component electrophotographic developer that contains the carrier particles having the above properties.

SUMMARY OF THE INVENTION

The present inventors have made intensive studies with a view toward solving the aforementioned problems, and have found that higher bond strength between the core and coating resin layer can be achieved by chemically bonding a coating resin and a core-forming binder resin. The present invention has been accomplished based on the finding.

A carrier for electrophotographic developer according to the present invention comprises a resin carrier core comprising a binder resin and magnetic powder dispersed in the binder resin, and a coating layer comprising a coating resin on a surface of the core, the binder resin being a silicone resin obtained by curing of a polysiloxane compound (A) having an epoxy group and a polysiloxane compound (B) having a functional group (b) capable of reacting with the epoxy group, due to a ring-opening addition reaction;

the silicone resin containing at least one functional group (c) selected from the group consisting of an epoxy group derived from the polysiloxane compound (A) and a functional group (b) derived from the polysiloxane compound (B);

the coating resin containing at least one functional group (s) selected from the group consisting of an epoxy group and a functional group (d) capable of reacting with an epoxy group;

the functional group (c) and the functional group (s) forming a chemical bond.

Preferably, the functional group (c) is an epoxy group, and the functional group (s) is a functional group (d) capable of reacting with an epoxy group.

Also preferably, the functional group (c) is a functional group (b) capable of reacting with an epoxy group, and the functional group (s) is an epoxy group.

Preferably, the functional groups (b) and (d) capable of reacting with an epoxy group are each at least one functional group selected from the group consisting of an amino group, a carboxyl group, a mercapto group and a carbinol group. Particularly preferably, they are each an amino group.

The coating resin is preferably at least one resin selected from the group consisting of a silicone resin, a modified silicone resin and a modified acrylic resin, and preferably contains a fluorine atom.

The resin carrier core is preferably obtained by mixing the polysiloxane compound (A), the polysiloxane compound (B) and magnetic powder, suspending the mixture in an aqueous medium, and curing.

A two-component electrophotographic developer according to the present invention comprises the above carrier for electrophotographic developer and toner particles having a volume-average particle diameter in the range of 3 to 15 μm.

BRIEF DESCRIPTION OF THE DRAWINGS

FIG. 3 is an enlarged schematic sectional view of a conventional carrier for electrophotographic developer; wherein:

10 . . . Resin-coated carrier
12 . . . Binder resin
12*a* . . . Binder resin molecule
14 . . . Magnetic powder
16 . . . Coating resin layer
16*a* . . . Coating resin molecule

DESCRIPTION OF THE PREFERRED EMBODIMENTS

The carrier for electrophotographic developer of the invention will be hereinafter described in detail.

Carrier for Electrophotographic Developer

Figure 1:
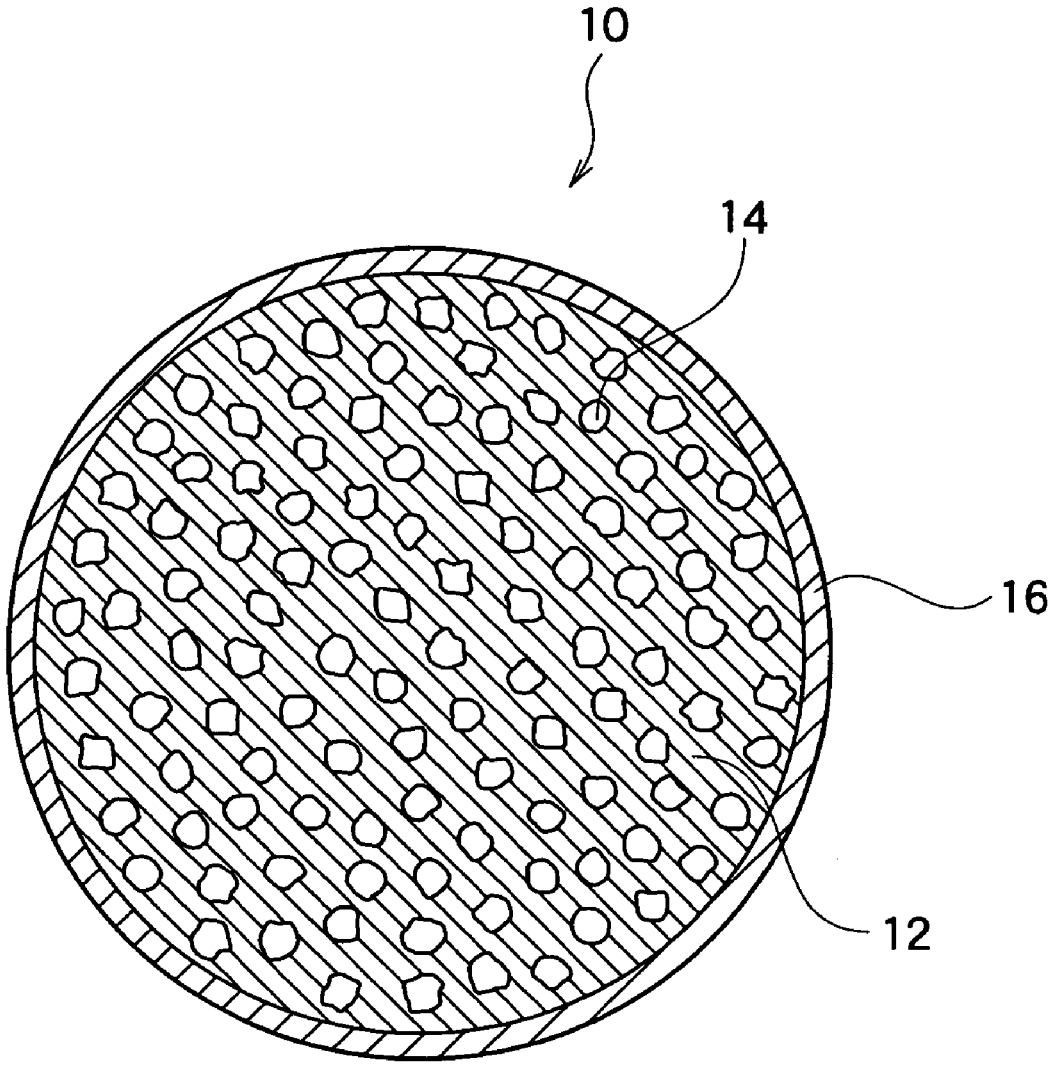
FIG. 1 is a schematic sectional view of a carrier for electrophotographic developer according to the present invention.

The carrier for electrophotographic developer of the present invention comprises a resin carrier core comprising a binder resin and magnetic powder dispersed in the resin, and a coating resin layer formed on a surface of the core. Specifically, as illustrated in FIG. 1, a carrier 10 for electrophotographic developer of the present invention comprises a resin carrier core in which magnetic powder 14 is dispersed in a binder resin 12, and a coating resin layer 16 formed on a surface of the core. The carrier for electrophotographic developer will be hereinafter referred to as the "resin-coated carrier".

Magnetic Powder-dispersed Resin-binder Carrier Core

The magnetic powder-dispersed resin-binder carrier core (hereinafter, the "carrier core") maybe obtained by mixing the binder resin raw materials and magnetic powder, suspending the mixture in an aqueous medium, and curing. Preparation in this manner permits easy control of the shape of the carrier core and can produce carrier cores having very small particle-size distribution width, reduced exposure of the magnetic powder, excellent flowability and superior toner-charging capability.

<Magnetic Powder>

The magnetic powder used in the invention may be conventional, with examples including iron powder, iron nitride powder, nickel powder, Fe—Si alloy powder, Fe—Al—Si alloy powder, ferrite powder, magnetite powder and maghemite powder. The magnetic powder generally has a volume-average particle diameter of 0.01 to 10 μm, preferably 0.05 to 8.0 μm. Any volume-average particle diameter less than 0.01 μm leads to significant aggregation of the magnetic powder by van der Waals attraction and the like, and makes it difficult for the magnetic powder to be dispersed in the binder resin homogeneously. When the magnetic powder has a volume-average particle diameter exceeding 10 μm, the magnetic powder protrudes from the carrier core to deteriorate the shape, forms a leakage point of electric charge, and is easily released.

The magnetic powder is generally used in an amount of 20 to 95 parts by weight, preferably 35 to 90 parts by weight based on 100 parts by weight of the carrier core. When the amount is less than 20 parts by weight, it is difficult to attain the desired magnetization. Any amount exceeding 95 parts by weight makes it difficult to disperse the magnetic powder in the carrier core homogeneously. When the magnetic powder having the above particle diameter is used in the above amount, the magnetic powder can be homogeneously dispersed in the binder resin, and the resin-coated carrier obtained exhibits sufficient magnetic properties.

Further, the magnetic powder used in the invention is preferably lipophilized. The lipophilic treatment improves the adhesion between the magnetic powder and the binder resin, and reduces the release of the magnetic powder. In an example of the lipophilic treatments, the magnetic powder may be coated with a material having high affinity for the binder resin and the material may be caused to adhere to the surface of the magnetic powder by heat treatment or the like. Examples of the materials having high affinity for the binder resin include known coupling agents such as silane coupling agents, aluminate coupling agents and titanate coupling agents. They may be used singly or in combination of two or more kinds.

<Binder Resin>

The binder resin used in the invention is a silicone resin obtained by curing of a polysiloxane compound (A) having an epoxy group and a polysiloxane compound (B) having a functional group (b) capable of reacting with the epoxy group, namely, a polysiloxane compound (B) having active hydrogen in the functional group, due to a ring-opening addition reaction.

(A) Polysiloxane Compound Having an Epoxy Group:

It is important that the polysiloxane compound (A) used in the invention contain a ring-opening epoxy group as a functional group. The polysiloxane compound (A) used herein is substantially free of such functional groups as alkoxyl groups so as not to produce any by-products such as alcohol and water in the ring-opening addition reaction. Preferably, the polysiloxane compound (A) contains no aromatic rings such as benzene ring in the structure. When the binder resin is prepared using a polysiloxane compound with a benzene ring in the structure, the resin-coated carrier obtained is often greatly deteriorated in environmental stability of charging capability and resistance to toner-spent.

Preferably, the polysiloxane compound (A) has an epoxy group at least in a side chain thereof. Particularly preferably, the polysiloxane compound has at least two, or three or more side-chain epoxy groups in the molecule. The polysiloxane compound (A) having plural side-chain epoxy groups can form more crosslinks with the polysiloxane compound (B) described later and can thereby provide a sturdier structure as compared with the same type of polysiloxane compounds having an epoxy group only at an end of the main chain. Accordingly, the mechanical strength of the resin-coated carrier can be improved.

The epoxy equivalent weight of the polysiloxane compound (A) is generally in the range of 200 to 1500 g/mol, preferably 300 to 900 g/mol, particularly preferably 400 to 700 g/mol. When the epoxy equivalent weight is in the above range, the polysiloxane compound (A) can favorably undergo curing reaction with the polysiloxane compound (B) due to a ring-opening addition reaction to provide a carrier core having superior mechanical strength. Furthermore, the above epoxy equivalent weight gives another advantage that when the coating resin layer described later is formed, the epoxy group favorably reacts with a functional group (d) in the coating resin, and the coating resin layer can be directly joined with the binder resin layer by chemical bonds. As a result, the resin-coated carrier obtained is resistant to separation of the coating resin layer and possesses desired charging properties.

The epoxy equivalent weight of the polysiloxane compound (A) may be determined by, for example, dissolving a sample of the polysiloxane compound (A) in methyl ethyl ketone, adding glacial acetic acid, adding excess cetyl trimethyl ammonium bromide, and immediately titrating with a glacial acetic acid solution of perchloric acid using crystal violet as indicator.

The polysiloxane compound (A) is desirably in a fluid state at room temperature and preferably has a viscosity at 25° C. of not more than 10000 cP. When the viscosity is above 10000 cP, the polysiloxane compound (A) and the polysiloxane compound (B) are not mixed homogeneously in preparing the carrier core. Consequently, the ring-opening addition reaction is performed unevenly among and within the core particles, and hence the carrier core obtained has non-uniform composition. Therefore, the carrier core having the desired properties may not be obtained.

(B) Polysiloxane Compound Having a Functional Group (b) Capable of Reacting with an Epoxy Group:

The polysiloxane compound (B) has a functional group (b) capable of reacting with an epoxy group, and this functional group (b) desirably does not generate any by-products such as water and alcohol in the ring-opening addition reaction. Examples of the functional group (b) include an amino group, a carboxyl group, a mercapto group and a carbinol group. Specifically, the polysiloxane compound (B) has at least one functional group selected from the above groups. The polysiloxane compound (B) may contain different types of the functional groups (b) in the molecule, or may be a combination of a polysiloxane compound having a specific functional group (b) and one or more polysiloxane compounds having a different functional group (b). When two or more types of the polysiloxane compounds are used in combination, each of the polysiloxane compounds is substantially free of such functional groups as alkoxyl groups so as not to generate any by-products such as water and alcohol in the ring-opening addition reaction.

The polysiloxane compound (B) generally has an equivalent weight of the functional group (b) in the range of 100 to 4000 g/mol, preferably 200 to 1000 g/mol, particularly preferably 300 to 800 g/mol. When the equivalent weight of the functional group (b) is in the above range, the polysiloxane compound (B) can favorably undergo curing reaction with the polysiloxane compound (A) due to a ring-opening addition reaction to provide a carrier core having superior mechanical strength. Furthermore, the above functional group equivalent weight gives another advantage that when the coating resin layer described later is formed, the functional group (b) favorably reacts with the functional group (s) in the coating resin, and the coating resin layer can be directly joined with the binder resin layer by chemical bonds; as a result, the resin-coated carrier obtained is resistant to separation of the coating resin layer and possesses desired charging properties. In this case, it is particularly preferable that the coating resin contains an epoxy group and an amino group as the functional group (s) in view of high reaction activity and no by-products generated in the reaction.

The functional group equivalent weight of the polysiloxane compound (B) may be determined by subjecting a sample of the polysiloxane compound (B) to quantitative analysis appropriate for the function group. For example, the amino group equivalent weight of the polysiloxane compound (B) may be obtained by hydrolyzing a sample of the polysiloxane compound (B) with a strong alkali to render the compound soluble in water, and determining the amino group with an ion chromatograph.

The carboxyl group equivalent weight of the polysiloxane compound (B) may be determined by dissolving a sample of the polysiloxane compound (B) in toluene, and titrating with a previously standardized 0.1 M potassium hydroxide alcohol solution using a bromthymol blue-phenol red mixture indicator.

The mercapto group equivalent weight of the polysiloxane compound (B) may be determined by hydrolyzing a sample of the polysiloxane compound (B) with a strong alkali to render the compound soluble in water, coloring with a coloring reagent such as nitrous acid or p-chloromethacryl benzoic acid, and determining the mercapto group by absorptiometry.

The carbinol group equivalent weight of the polysiloxane compound (B) may be determined in accordance with a method for testing chemical products for acid value, saponification value, ester value, iodine value, hydroxyl value and unsaponifiable matters, specified in JIS K 0070.

Preferably, the polysiloxane compound (B) has the functional group (b) capable of reacting with an epoxy group, in a side chain thereof. Particularly preferably, the polysiloxane compound has two or three or more side-chain functional groups (b) in the molecule. The polysiloxane compound (B) having plural side-chain functional groups (b) can form more crosslinks with the polysiloxane compound (A) and can thereby provide a sturdier structure as compared with the same type of polysiloxane compounds having a functional group (b) only at an end of the main chain. Accordingly, the mechanical strength of the resin-coated carrier can be improved.

Examples of the polysiloxane compound (B) include amino-modified polysiloxane compounds such as amino-modified silicone resins, amino-modified silicone oils and amino-modified silicone oligomers; carboxy-modified polysiloxane compounds such as carboxy-modified silicone resins, carboxy-modified silicone oils and carboxy-modified silicone oligomers; mercapto-modified polysiloxane compounds such as mercapto-modified silicone resins, mercapto-modified silicone oils and mercapto-modified silicone oligomers; and carbinol-modified polysiloxane compounds such as carbinol-modified silicone resins, carbinol-modified silicone oils and carbinol-modified silicone oligomers. These polysiloxane compounds may be used singly or in combination of two or more kinds.

In particular, the amino group-containing polysiloxane compounds such as amino-modified silicone resins are preferable because the amino group favorably reacts with the epoxy group in the polysiloxane compound (A) to form a binder resin showing high strength after cured, so that the resin-coated carrier obtained is resistant to breakage by stress in a developing apparatus. Furthermore, the use of the amino group-containing polysiloxane compounds leads to the carrier core having excellent charging capability uniform within the carrier core. This carrier core can maintain charging properties stably for a long term even if it is not completely coated with the resin. In particular, the resin-coated carrier obtained herein has excellent capability of negatively charging toners and a high rate of charge building, and hardly causes fog or toner scattering.

The amino group-containing polysiloxane compound contains at least one of a primary amino group and a secondary amino group, or contains both a primary amino group and a secondary amino group in the same side chain group, or is a combination of a polysiloxane compound containing a primary amino group and a polysiloxane compound containing a secondary amino group. Any of these compounds can favorably provide the binder resin used in the invention, and the desired resin-coated carrier can be obtained. Favorable results can also be obtained even by using polysiloxane compounds containing the above amino group(s), and a tertiary amino group and/or a quaternary amino group. Of these compounds, the polysiloxane compounds containing at least a primary amino group are particularly preferred.

The polysiloxane compound (B) is desirably in a fluid state at room temperature and has a viscosity at 25° C. of not more than 10000 cP. When the viscosity is above 10000 cP, the polysiloxane compound (A) and the polysiloxane compound (B) are not mixed homogeneously in preparing the carrier core. Consequently, the ring-opening addition reaction takes place non-uniformly among and within the core particles to make it difficult to achieve a uniform composition of the carrier cores. Therefore, the resin-coated carrier having the desired properties may not be obtained.

The binder resin in the invention is formed from the polysiloxane compounds (A) and (B) as binder resin raw materials, and the carrier core obtained can satisfy both reduced critical surface tension and improved adhesion with the magnetic powder. Consequently, the magnetic powder release or toner-spent can be prevented during long-term printing, and the deterioration of charging capability is small.

The ring-opening addition reaction of the epoxy group can be confirmed as follows. An infrared absorption spectrum (spectrum 1) of a mixture of the polysiloxane compound (A) and the polysiloxane compound (B) is measured using a Fourier transform infrared spectrometer (FT-IR) Subsequently, an infrared absorption spectrum (spectrum 2) of a thermally cured product of the mixture is measured in a similar manner. The spectrum 1 provides an absorption peak assigned to the epoxy ring of the polysiloxane compound (A), whereas the spectrum 2 shows that the area of this absorption peak is significantly reduced. This fact suggests that the chemical bond is changed in such a way that the epoxy rings of the polysiloxane compound (A) are opened and are addition reacted with the functional groups (b) of the polysiloxane compound (B). That is, the polysiloxane compound (A) and the polysiloxane compound (B) are cured through the ring-opening of the epoxy rings and the addition reaction with the functional groups (b).

The polysiloxane compound (A) and the polysiloxane compound (B) are desirably contained in an amount of not less than 90 parts by weight based on 100 parts by weight of the total amount of the binder resin raw materials. When the total amount of the polysiloxane compounds (A) and (B) is less than 90 parts by weight, the ring-opening addition reaction forms less crosslinks and the mechanical strength will be lowered.

The ratio of the number of the epoxy groups in the polysiloxane compound (A) to that of the functional groups (b) in the polysiloxane compound (B) (epoxy groups/functional groups (b)) is desirably in the range of 0.3 to 3.0, preferably 0.5 to 2.0. When the ratio of the functional group numbers is in the above range, the ring-opening addition reaction favorably takes place between the polysiloxane compound (A) and the polysiloxane compound (B) to enable production of the resin-coated carrier with superior mechanical strength.

The mixture of the polysiloxane compound (A) and the polysiloxane compound (B) desirably has a change in specific gravity before and after heated at 120° C. in the range of 0.8 to 1.2, preferably 0.8 to 1.0. The change in specific gravity in this range permits a small volume change in curing, so that voids and cracks in the carrier core can be reduced, good adhesion can be achieved between the magnetic powder and the binder resin, and the carrier particles show superior mechanical strength.

The amount of by-products produced in the ring-opening addition reaction of the polysiloxane compounds (A) and (B) is preferably less than 20 parts by weight, more preferably less than 15 parts by weight based on 100 parts by weight of the total amount of the binder resin raw materials before the reaction. When the binder resin has the above amount of by-products, the resin-coated carrier obtained will have reduced possibility of voids in the carrier core, superior mechanical strength, less magnetic powder release, and high durability.

Meanwhile, the polysiloxane compounds used in the conventional magnetic powder-dispersed binder resin carriers are obtained by crosslinking and curing through condensation reaction, and a large amount of by-products are generated in curing. The consequent voids in the resin carrier particles lead to poor mechanical strength and easy release of magnetic powder, causing inferior durability.

The binder resin of the invention contains at least one functional group (c) selected from an epoxy group derived from the polysiloxane compound (A) and a functional group (b) derived from the polysiloxane compound (B).

The binder resin having a functional group (c) may be prepared as follows depending on the kind of the functional group (c).

(i) When the Functional Group (c) is an Epoxy Group:

The binder resin in which the functional group (c) is an epoxy group forms chemical bonds with the coating resin containing a functional group (d) capable of reacting with an epoxy group as the functional group (s). To react the epoxy functional group (c) with the functional group (d) of the coating resin, the polysiloxane compound (A) and the polysiloxane compound (B) are subjected to ring-opening addition reaction such that the epoxy groups of the polysiloxane compound (A) will remain in excess over the functional groups (b) of the polysiloxane compound (B). The ratio of the number of the epoxy groups in the polysiloxane compound (A) to that of the functional groups (b) in the polysiloxane compound (B) (epoxy groups/functional groups (b)) is desirably in the range of above 1.0 to 3.0, preferably above 1.0 to 2.0, particularly preferably above 1.0 to 1.4. When the ratio of the functional group numbers is in the above range, the binder resin can contain a sufficient amount of unreacted epoxy groups for reaction with the functional groups (d) of the coating resin to achieve increased adhesion with the coating layer. Furthermore, this ratio can reduce adverse effects brought about by excess of unreacted residual epoxy groups, such as lowering in carrier characteristics, for example lowered stability of charge quantity. As a result of the reaction, the epoxy groups of the binder resin and the functional groups (d) of the coating resin are bonded by the chemical reaction, and the core resin phase and the coating resin layer are directly joined by chemical bonds. Consequently, the resin-coated carrier obtained has improved adhesion between the carrier core and the coating resin layer, reduced possibility of separation of the coating resin layer, and desired charging properties. Because of the high reaction activity of the epoxy groups, the epoxy group-containing binder resin can achieve high bond strength with the coating resin containing the functional groups (d), and the carrier core and the coating resin layer are resistant to separation.

The polysiloxane compound (A) preferably has a plurality of epoxy groups in side chains because the binder resin can form many chemicals bonds with the coating resin containing the functional groups (d). When the polysiloxane compound (A) has plural side-chain epoxy groups, the binder resin obtained can achieve higher bond strength with respect to the coating resin because of many unreacted residual epoxy groups in the side chains thereof, and the resin-coated carrier obtained is more resistant to separation of the coating resin layer, as compared with when the polysiloxane compound (A) has epoxy groups only at ends of the main chain.

(ii) When the Functional Group (c) is a Functional Group (b) Capable of reacting with an Epoxy Group:

The binder resin in which the functional group (c) is a functional group (b) capable of reacting with an epoxy group favorably forms chemical bonds with the coating resin containing an epoxy group as the functional group (s). The functional group (b) of the binder resin is derived from the polysiloxane compound (B), and examples thereof include an amino group, a carboxyl group, a mercapto group and a carbinol group. The functional group (b) may consist of one or two or more kinds of these functional groups. To react the functional group (b) as the functional group (c) with the functional group (s) of the coating resin, the polysiloxane compound (A) and the polysiloxane compound (B) are subjected to ring-opening addition reaction such that the functional groups (b) of the polysiloxane compound (B) will be excess over the epoxy groups of the polysiloxane compound (A), namely, such that the functional groups (b) as the functional groups (c) will remain unreacted in the binder resin. The ratio of the number of the epoxy groups in the polysiloxane compound (A) to that of the functional groups (b) in the polysiloxane compound (B) (epoxy groups/functional groups (b)) is desirably in the range of 0.3 to less than 1.0, preferably 0.5 to less than 1.0, particularly preferably 0.7 to less than 1.0. When the ratio of the functional group numbers is in the above range, the binder resin can contain a sufficient amount of unreacted functional groups (b) for reaction with the epoxy groups of the coating resin to form chemical bonds with the coating layer with increased adhesion. Furthermore, this ratio can reduce adverse effects brought about by excess of unreacted residual functional groups (b), such as lowering in carrier characteristics, for example lowered stability of charge quantity. As a result of the reaction, the functional groups (b) of the binder resin and the functional groups (s) of the coating resin are bonded by the chemical reaction, and the core resin phase and the coating resin layer are directly joined by chemical bonds. Consequently, the resin-coated carrier obtained has improved adhesion between the carrier core and the coating resin layer, reduced possibility of separation of the coating resin layer, and desired charging properties. The binder resin containing the functional groups (b) can achieve higher bond strength with the coating resin containing epoxy groups and can reduce the separation of the carrier core and the coating resin layer, as compared with binder resins having no functional groups.

Particularly preferably, the functional group (b) is an amino group. The amino group-containing binder resin can favorably form chemical bonds with the coating resin containing epoxy groups, and the bond strength of the binder resin and the epoxy group-containing coating resin is so strong that the separation of the coating resin layer is unlikely even during long-term use.

The amino group-containing binder resin contains either a primary amino group or a secondary amino group, or contains both a primary amino group and a secondary amino group in the molecule, or is a combination of a binder resin containing a primary amino group and a binder resin containing a secondary amino group. Any of these resins can be favorably bonded with the epoxy group-containing coating resin, and the desired resin-coated carrier resistant to separation of the coating resin layer can be obtained. Favorable results can also be obtained even by using binder resins containing a primary amino group and/or a secondary amino group, and a tertiary amino group and/or a quaternary ammonium salt. Of these resins, the binder resins containing at least a primary amino group are particularly preferred.

(iii) When the Functional Group (c) Consists of an Epoxy Group and a Functional Group (b):

When the functional group (c) of the binder resin consists of an epoxy group and a functional group (b), such a binder resin forms chemical bonds with the coating resin in which the functional group (s) consists of an epoxy group and a functional group (d). The binder resin containing an epoxy group and a functional group (b) may be obtained by subjecting the polysiloxane compound (A) and the polysiloxane compound (B) to ring-opening addition reaction under conditions such that the epoxy group and functional group (b) will remain when the binder resin is cured to form the carrier core. In a specific example of production, the binder resin may be obtained while the curing reaction time for the core is shortened or the temperature in the thermal curing is lowered so that the functional group (c) will remain unreacted and the carrier core will maintain sufficient mechanical strength in the following step of forming the coating resin layer. The ratio of the number of the epoxy groups in the polysiloxane compound (A) to that of the functional groups (b) in the polysiloxane compound (B) (epoxy groups/functional groups (b)) is not particularly limited, but is desirably in the range of 0.3 to 3.0, preferably 0.5 to 2.0, particularly preferably 0.7 to 1.3. When the ratio of the functional group numbers is in the above range, the functional groups (s) in the coating resin and the functional groups (c) remaining in the binder resin can favorably react with each other to achieve sufficient coating durability. Furthermore, when the above ratio is satisfied, the functional groups do not remain in excess after reaction with the coating resin, and the resin-coated carrier obtained exhibits good charging properties.

Because of the high reaction activity of the epoxy groups, the reaction can take place favorably between the epoxy groups of the binder resin and the functional groups (d) of the coating resin and between the functional groups (b) of the binder resin and the epoxy groups of the coating resin. Thus, the binder resin containing the epoxy groups and functional groups (b) can achieve high bond strength with the coating resin, and can reduce the separation of the carrier core and the coating resin layer.

The binder resin may contain various kinds of known additives as required in addition to the polysiloxane compounds (A) and (B). Examples of the additives include curing agents, crosslinking agents, charging controlling agents, conductivity controlling agents and fluidity controlling agents.

(Curing Agents)

The ring-opening addition reaction may involve a curing agent as required. The use of curing agent enables favorable control of the reaction rate, the crosslinking density of the binder resin, and the residual amount of the unreacted functional groups.

The curing agent used herein may be conventional, with examples including:

aliphatic primary amines such as ethylenediamine, diethylenetriamine, triethylenetetramine, tetraethylenepentamine, diethylaminopropylamine, m-hexamethylene-triamine, Epomate(R) and 1,3-diaminomethylcyclohexane;

aliphatic secondary amines such as piperidine, imidazole and polyamidoamine;

aliphatic tertiary amines such as triethylamine, aminoethylpiperazine and tetramethylguanidine;

aromatic primary amines such as m-phenylenediamine, diamino-diphenyl-methane and diamino-diphenyl-sulfone;

aromatic tertiary amines such as benzyldimethylamine, 2,4,6-tris(dimethylaminomethyl)phenol and 2-methylaminomethyl phenol;

modified amines such as amine-glycidyl ether adduct, amine-cyanoethyl adduct and amine-phenyl glycidyl ether adduct;

acid anhydrides such as phthalic anhydride, maleic anhydride, hexahydrophthalic anhydride, 3-methyl-1,2,3,6-tetrahydrophthalic anhydride, 4-methyl-1,2,3,6-tetrahydrophthalic anhydride, pyromellitic anhydride, trimellitic anhydride, trimellitic glycol, methyl nadic anhydride, chlorendic anhydride, dodecylsuccinic anhydride, dichloromaleic anhydride, polyazelaic anhydride and polysebacic anhydride;

alcohols such as ethylene glycol, propylene glycol, polyethylene glycol and polyvinyl alcohol; and thiols such as liquid polysulfide and polymercaptan.

Of these, the compounds having no aromatic rings are preferred because they do not deteriorate the environmental stability and toner-spent resistance. These curing agents may be used singly or in combination of two or more kinds.

These curing agents are desirably used in amounts of not more than 10 parts by weight, preferably not more than 1 part by weight based on 100 parts by weight of the total amount of binder resin raw materials. The use of the curing agents in amounts exceeding the upper limit may make controlling the desired reaction rate difficult, and may impair the effects achieved by using the polysiloxane compounds after curing. Specifically, the overuse of the curing agents often deteriorates the properties such as low critical surface tension, prevention of toner-spent, and high fluidity of the carrier to give momentarily a desired charge to the toner. Thus, the performance of the resin-coated carrier will be lowered.

(Organosilane Compound)

The preparation of the binder resin may involve, in addition to the polysiloxane compounds (A) and (B), an organosilane compound having a functional group capable of reacting with the functional group of the polysiloxane compound (A) or (B). The functional groups of such organosilane compounds include an epoxy group, an amino group, a carboxyl group, a mercapto group and a carbinol group. When the functional group of the organosiloxane compound is an epoxy group, the epoxy group reacts with the functional group (b) of the polysiloxane compound (B). When the functional group of the organosiloxane compound is at least one functional group selected from the group consisting of an amino group, a carboxyl group, a mercapto group and a carbinol group, the functional group reacts with the epoxy group of the polysiloxane compound (A).

The above organosilane compound having the functional group possesses high reactivity with the polysiloxane compound (A) and/or the polysiloxane compound (B), permits the magnetic powder to disperse homogeneously in the binder resin, and provides improved adhesion between the magnetic powder and the binder resin to reinforce the binder resin. Consequently, the carrier core having uniform charging properties, reduced release of the magnetic powder and excellent mechanical strength can be obtained more easily. In particular, the organosilane compounds containing an amino group are preferred because of high reactivity with the epoxy group-containing polysiloxane compound (A). Furthermore, the organosilane compounds containing an epoxy group are preferable when the polysiloxane compound (B) has an amino group because they have high reactivity with the amino group-containing polysiloxane compound (B).

Examples of the organosilane compounds include:

epoxy group-containing organosilane compounds such as

β(3,4-epoxycyclohexyl)ethyltrimethoxysilane,
γ-glycidoxypropyltrimethoxysilane,
γ-glycidoxypropylmethyldimethoxysilane,
γ-glycidoxypropyltriethoxysilane and
γ-glycidoxypropylmethyldiethoxysilane;

amino group-containing organosiloxane compounds such as

γ-aminopropyltrimethoxysilane, γ-aminopropyltriethoxysilane,
N-β (aminoethyl) γ-aminopropyltrimethoxysilane,
N-β (aminoethyl)γ-aminopropylmethyldimethoxysilane,
N-β (aminoethyl)γ-aminopropyltriethoxysilane,
N-β (aminoethyl) γ-aminopropylmethyldiethoxysilane,
chloro-γ-(trimethylamino)propyltrimethoxysilane and
chloro-γ-(trimethylamino)propyltriethoxysilane;

carboxyl group-containing organosilane compounds such as

γ-carboxypropyltrimethoxysilane and
γ-carboxypropyltriethoxysilane; and mercapto group-containing organosilane compounds such as γ-mercaptopropyltrimethoxysilane,
γ-mercaptopropylmethyldimethoxysilane,
γ-mercaptopropyltriethoxysilane and
γ-mercaptopropylmethyldiethoxysilane.

These organosilane compounds may be used singly or in combination of two or more kinds in view of charging properties of the toner used together with the resin-coated carrier.

The organosilane compound is desirably used in an amount of not more than 10 parts by weight, preferably not more than 8 parts by weight, still preferably not more than 5 parts by weight based on 100 parts by weight of the polysiloxane silicone compounds (A) and (B) combined. When the organosilane compound is used in an amount exceeding the upper limit, a large amount of by-products will be derived from the organosilane compound in the curing to possibly cause voids or cracks in the carrier core.

<Carrier Core>

The carrier core used in the invention may be obtained by uniformly mixing the magnetic powder, polysiloxane compound (A) and polysiloxane compound (B), and optionally the curing agent and organosilane compound, with a kneading apparatus such as rollers, kneader or extruder, then suspending the mixture in an aqueous medium, and curing the mixture by ring-opening addition reaction.

The aqueous medium is generally water. A small amount of various organic solvents such as methyl alcohol, ethyl alcohol and isopropyl alcohol may be added to water to adjust appropriately the polarity, dielectric constant and surface tension of the aqueous medium.

The aqueous medium is generally used in an amount of 100 to 1000 parts by weight, preferably 300 to 600 parts by weight based on 100 parts by weight of the aforesaid mixture. When the amount of the aqueous medium is less than 100 parts by weight, the suspension stability of the mixture in the medium is often lowered. The amount thereof exceeding 1000 parts by weight may lead to deterioration of productivity and is therefore unfavorable.

In suspending the mixture in the aqueous medium, a suspension stabilizer or a dispersant may be added to the aqueous medium in order to control the shape, particle diameter and particle size distribution of the carrier core. Examples of the suspension stabilizers and dispersants include water-soluble high-molecular compounds, anionic surface-active agents, cationic surface-active agents, amphoteric surface-active agents and nonionic surface-active agents.

The water-soluble high-molecular compounds include inorganic salts such as calcium phosphate, calcium carbonate and magnesium carbonate; polyvinyl alcohol and polyethylene glycol.

The anionic surface-active agents include fatty acid salts such as sodium oleate and castor oil; alkyl sulfate esters such as sodium lauryl sulfate and ammonium lauryl sulfate; alkyl benzenesulfonates such as sodium dodecylbenzenesulfonate; alkyl naphthalene sulfonates, alkyl phosphates, naphthalene sulfonic acid-formalin condensates and polyoxyethylene alkyl sulfates.

The cationic surface-active agents include alkylamine salts such as laurylamine acetate; and quaternary ammonium salts such as lauryl trimethyl ammonium chloride and stearyl trimethyl ammonium chloride.

The amphoteric surface-active agents include aminocarboxylates and alkylamino acids.

The nonionic surface-active agents include polyoxyethylene alkyl ethers, polyoxyethylene fatty acid esters, sorbitan fatty acid esters, polyoxyethylene alkylamines, glycerin, fatty acid esters and oxyethylene-oxypropylene block copolymers.

The suspension stabilizers and dispersants may be used in amounts of not more than 30 parts by weight, preferably not more than 20 parts by weight based on 100 parts by weight of the aqueous medium. When the amount of the suspension stabilizer or dispersant is above 30 parts by weight, removal of the suspension stabilizer or dispersant is often difficult and the resulting carrier particles may have bad environmental dependency.

(Preparation Method)

The mixture containing the magnetic powder, polysiloxane compound (A) and polysiloxane compound (B), and optionally the curing agent, organosilane compound and other additives is suspended in the aqueous medium containing the suspension stabilizer and dispersant, by using, for example, a mixing apparatus equipped with a stirring blade. The diameter of the above-suspended particles of the mixture substantially corresponds to the particle diameter of the resulting carrier core. Accordingly, it is desirable to suspend the mixture in the aqueous medium as homogeneously as possible.

The suspension is then heated. The heating induces ring-opening addition reaction of the epoxy groups in the suspended particles, and the curing proceeds. The heating temperature is generally in the range of 50° C. to less than 100° C., preferably in the range of 70 to 90° C. The heating time under this temperature condition is generally in the range of 1 to 10 hours. When the heating temperature is less than 50° C., the ring-opening addition reaction is slow and takes considerable time, lowering productivity. The aqueous medium may boil at 100° C. or above and ordinary pressure, and the reaction must be performed under pressure. Therefore, industrial production entails enormous facilities.

After the ring-opening addition reaction, the suspension is cooled to near room temperature and the suspension stabilizer and dispersant are removed. For example, when calcium phosphate is used as the suspension stabilizer, it can be removed by acidifying the suspension with hydrochloric acid or the like to dissolve calcium phosphate and thereafter repeatedly washing the suspended particles with water.

The suspension particles are then separated by a common solid-liquid separation method such as filtration, pressure filtration or centrifugation. The particles separated are dried and are cured by heating in order to attain sufficient mechanical strength required for subsequent steps. The heating is performed under conditions such that a desired amount of the unreacted epoxy groups and/or functional groups (b) will remain in the binder resin, and the desired carrier core may be thus obtained. Specifically, the heating is desirably carried out at 50 to 250° C., preferably 70 to 200° C., for 1 to 10 hours. When the heating temperature is below 50° C., achieving the desired reaction rate takes time and the productivity is lowered. When the temperature exceeds 250° C., the ring-opening addition reaction proceeds too far and the functional groups (c) in the binder resin are reduced, so that sufficient chemical bonds cannot be formed between the functional groups (c) of the binder resin and the functional groups (s) of the coating resin. Consequently, the bond strength between the carrier core and the coating resin layer is lowered, and the coating resin layer is often separated from the carrier core. Furthermore, such excessive temperature may deteriorate the binder resin to lower the performance of the resin-coated carrier.

The thus-prepared carrier core is cooled to near room temperature, followed by pulverization and classification as required.

The amount of the functional groups (s) in the coating resin may be determined appropriately depending on the amount of the functional groups (c) in the core. Therefore, the binder resin can favorably form chemical bonds with the coating resin, and the carrier core and the coating resin can be joined together with sufficient bond strength. The resin-coated carrier having superior charging properties may be thus obtained.

The carrier core generally has a volume-average particle diameter of 15 to 80 μm, preferably 20 to 60 μm, more preferably 20 to 50 μm. The particles having the volume-average particle diameter ±10 μm account for not less than 50% by weight, preferably not less than 65% by weight, more preferably not less than 80% by weight of all the carrier core particles.

<Coating Resin Layer>

Figure 2:
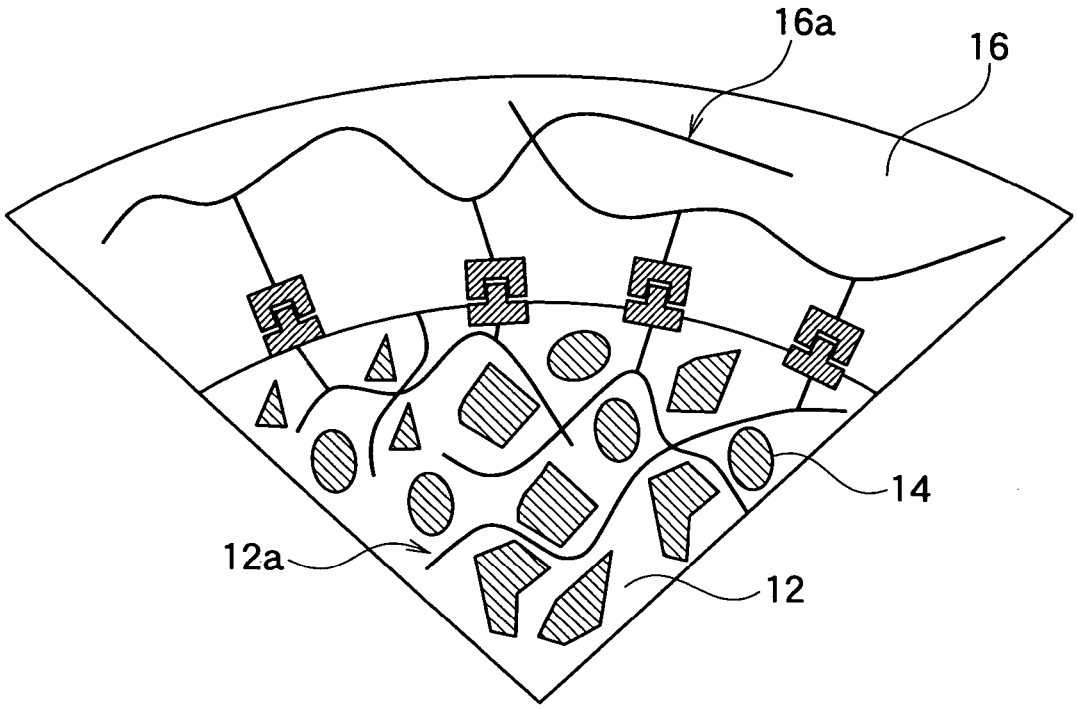
FIG. 2 is an enlarged schematic sectional view of a carrier for electrophotographic developer according to the present invention.
Figure 3:
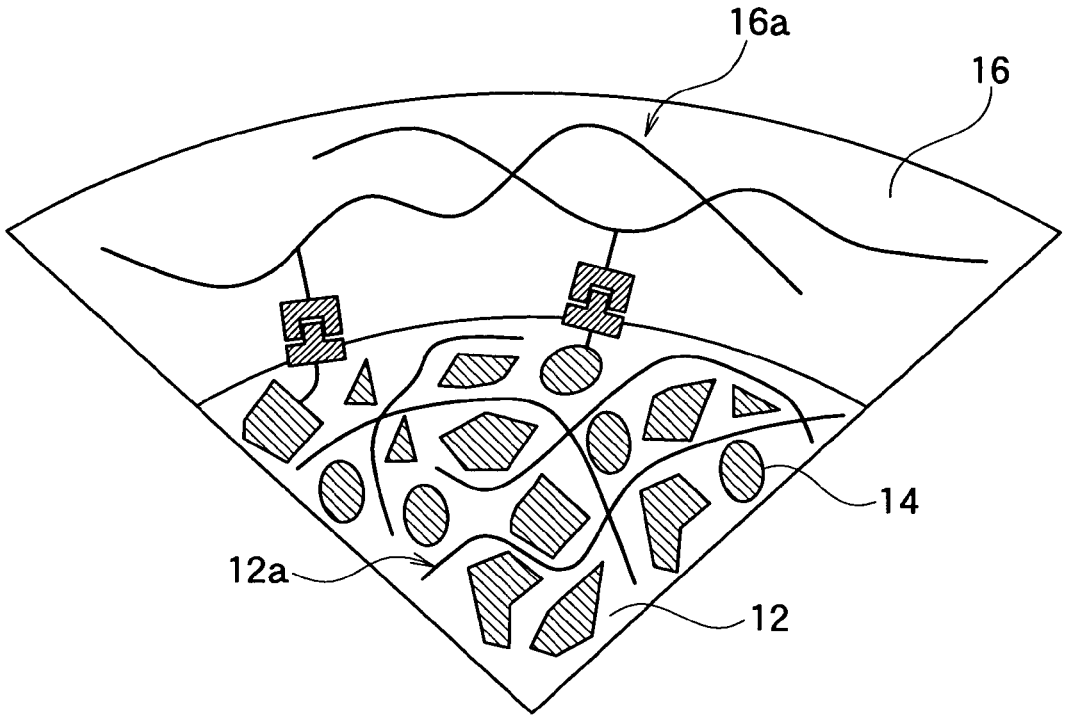

On the surface of the carrier core obtained as described above, the coating resin layer is formed to provide the resin-coated carrier of the present invention. The coating resin contains the functional group (s) that is capable of reacting with the functional group (c) of the binder resin. As illustrated in FIG. 2, the functional groups (c) of the binder resin and the functional groups (s) of the coating resin form chemical bonds to provide the hard-to-separate coating resin layer on the carrier core surface. The binder resin and the coating resin are used in the following combinations depending on the type of the functional group (c).

(i) When the Functional Group (c) is an Epoxy Group:

When the binder resin contains an epoxy group as the functional group (c), the coating resin is preferably a resin in which a functional group (d) similar to the functional group (b) capable of reacting with an epoxy group functions as the functional group (s). In view of reactivity with the epoxy group, the functional group (d) will be suitably selected based on the same criteria as that for selecting the functional group (b) of the polyorganosiloxane compound (B) as binder resin raw material.

(ii) When the Functional Group (c) is a Functional Group (b) Capable of Reacting with an Epoxy Group:

When the binder resin contains a functional group (b) capable of reacting with an epoxy group, the functional group (s) in the coating resin is particularly preferably an epoxy group.

(iii) When the Functional Group (c) Consists of an Epoxy Group and a Functional Group (b):

When the binder resin contains an epoxy group and a functional group (b), the coating resin preferably has an epoxy group and a functional group (d) as the functional groups (s). In this case, the functional groups (s) in the coating resin include an epoxy group and at least one functional group selected from the functional groups (d). In view of reactivity with the epoxy group, the functional group (d) will be suitably selected based on the same criteria as that for selecting the functional group (b) in the polyorganosiloxane compound (B). That is, the functional group (d) is preferably an amino group, a carboxyl group, a mercapto group or a carbinol group, and particularly preferably an amino group for its good reactivity with the epoxy group.

Preferably, the coating resin has a plurality of functional groups (s) in side chains thereof. Such a coating resin can form more chemical bonds with the binder resin having the functional groups (c) and can thereby provide a higher bond strength between the binder resin and the coating resin as compared when the coating resin has the functional groups (s) only at ends of the main chain. Accordingly, the resin-coated carrier obtained is more resistant to separation of the coating resin layer.

The functional group (s) equivalent weight of the coating resin may be determined appropriately depending on the functional group (c) equivalent weight of the binder resin and the amount of the coating resin. The functional group (s) equivalent weight is generally in the range of 80 to 5000 g/mol, preferably 200 to 3000 g/mol, particularly preferably 300 to 1500 g/mol. When the equivalent weight of the functional groups (s) is in the above range, the coating resin can be directly joined with the binder resin by chemical bonds to achieve sufficient bond strength between the carrier core and the coating resin, and the resin-coated carrier having excellent charging properties can be obtained. The functional group (s) equivalent weight may be determined by quantitative analysis appropriate for the function group as described hereinabove.

The coating resin is generally used in an amount of 0.01 to 10.0 parts by weight, preferably 0.05 to 7.0 parts by weight, more preferably 0.1 to 5.0 parts by weight based on 100 parts by weight of the carrier core. When the resin amount is less than 0.01 part by weight, it is difficult to form the coating resin layer uniformly on the surface of the carrier core. When the amount exceeds 10.0 parts by weight, the resin-coated carrier particles are easily aggregated to lower the productivity such as yield and to deteriorate developer properties such as fluidity in a developing device and charge quantity.

The coating resin used in the invention may be selected from known resins having the functional group (s) such that the resin-coated carrier will show desired charging properties. Examples of the coating resins include fluororesin, acrylic resin, epoxy resin, polyester resin, fluoroacrylate resin, fluoroepoxy resin, acrylic styrene resin and silicone resin; modified silicone resins such as silicone resins modified with acrylic resin, polyester resin, epoxy resin, alkyd resin, urethane resin or fluororesin; modified acrylic resins such as acrylic resins modified with silicone resin, polyester resin, epoxy resin, alkyd resin, urethane resin or fluororesin; polyamide resin, polyimide resin, polyamideimide resin, fluoro-polyamide resin, fluoro-polyimide resin and fluoro-polyamidimide resin.

The polyorganosiloxane compound (A) and/or the polyorganosiloxane compound (B) used as the binder resin raw materials are also employable as the coating resin. In this case, the resins may be mixed in an arbitrary ratio such that chemical reaction with the functional group (c) of the carrier core will take place and such that the desired charging properties can be obtained. The polyorganosiloxane compound (A) and/or the polyorganosiloxane compound (B) may be used directly or may be diluted with a known organic solvent capable of solving the resin as required to give a coating resin material. The solvents used herein are not particularly limited as long as they show good solvent properties, and include hydrocarbon solvents such as toluene, xylene, methaxylene, hexane and cyclohexane; alcohols such as methanol, ethanol and propyl alcohols; and ketons such as ethyl acetate, methyl ethyl ketone and dimethyl ketone.

Of the coating resins described above, those in which the functional group (s) is an epoxy group or an amino group are preferred for more stable developer properties over a long term and for preventing adverse effects under severe conditions in a developing device. Particularly preferred are the modified silicone resins having an epoxy group, modified acrylic resins having an epoxy group, modified silicone resins having an amino group, and modified acrylic resins having an amino group.

The use of the above resins leads to increased interlaminar adhesion between the carrier core and the coating resin layer to improve the durability, and provides the resin-coated carrier excellent in abrasion resistance, separation resistance and toner-spent resistance.

The coating resin preferably contains a fluorine atom. The fluorine-containing coating resin can provide lower surface energy of the coating resin layer, and the obtainable resin-coated carrier is resistant to contamination even when subjected to stress in the developing apparatus, permitting long-term stable charging properties. The fluorine-containing coating resin may be obtained by fluorinating the coating resin according to a common method. The fluorinating methods are not particularly limited and include use of the coating resin containing a fluorine atom in the structure and the functional group (s); addition of a fluorine-containing compound (such as a fluorine-containing silane coupling agent when the coating resin is silicone resin and/or modified silicone resin) to the coating resin composition containing the functional group (s); and dispersing or mixing a fluorine-containing resin in the coating resin composition containing the functional group (s).

To achieve higher strength of the coating resin layer, the coating resin may contain a crosslinking agent such as oxime crosslinking agent. Further, the coating resin may contain a charging controlling agent or conductive fine particles as required.

The charging controlling agent may be added to control the charging capability of the resin-coated carrier. Examples of the charging controlling agents include silane-coupling agents. The types of the silane-coupling agents are not particularly limited. However, an amino-silane-coupling agent is preferable for negatively charging the toner, and a fluorine-containing silane-coupling agent is preferable for positively charging the toner. The silane-coupling agent may be generally used in an amount of 0.01 to 50 parts by weight, preferably 0.1 to 30 parts by weight based on 100 parts by weight of the coating resin in terms of solid. Noticeable effects cannot be obtained when the amount of the charging controlling agent is too small, while too large an amount thereof can cause the charge quantity to be excessively increased by the stirring stress.

The conductive fine particles may be added to control the electrical resistance of the resin-coated carrier. It is often the case that the electrical resistance of the resin-coated carrier becomes excessively high and the developing capability of the developer is lowered when the amount of the coating resin increases. In such cases, the electrical resistance of the resin-coated carrier may be controlled by adding a small amount of the conductive fine particles to the coating resin layer.

Examples of the conductive fine particles include inorganic conductive fine particles such as conductive metal fine particles, conductive carbon, and oxides such as titanium oxide and tin oxide doped with antimony or the like. These may be used singly or in combination of two or more kinds.

The amount of the conductive fine particles added is generally in the range of 0.25 to 20.0% by weight, preferably 0.5 to 15.0% by weight, particularly preferably 1.0 to 12.0% by weight based on the solid content of the coating resin. The electrical resistance of the conductive fine particles is lower than those of the coating resin and the core. Therefore, excessive conductive fine particles can cause electric charge leakage from the resin-coated carrier.

Means for adding the conductive agent in the invention is not particularly limited. For example, the conductive fine particles may be pre-treated with a coupling agent, or may be uniformly dispersed in the coating resin composition containing a dispersant or the like.

<Method of Forming the Coating Resin Layer>

In a preferred method of forming the coating resin layer, the surface of the carrier core may be coated with the coating resin by a known method followed by heating so that the binder resin of the carrier core and the coating resin are chemically bonded. Examples of the coating methods include a brushing method, a dry method, a fluid-bed spray dry method, a rotary dry method, and an immersion dry method with a universal stirrer.

After the carrier core surface has been coated with the resin by the above method, the coating is generally heated at 70 to 360° C., preferably 80 to 340° C., particularly preferably 100 to 300° C. By the heating, the functional group (c) in the binder resin is reacted with the functional group (s) in the coating resin, and the coating resin is bonded to the carrier core surface. Heating at below 70° C. makes the reaction between the functional groups (c) and (s) slow, and it takes time for the coating resin to be firmly bonded. Temperatures exceeding 360° C. may induce chemical decomposition of the binder resin in the core and the coating resin. The resin-coated carrier having excellent interlaminar adhesion can be thus obtained.

<Resin-coated Carrier>

The resin-coated carrier produced as described above can achieve stable electrical resistance and charge quantity over long term because the coating resin layer is formed on the surface of the carrier core through chemical bonds. The electrical properties of the resin-coated carrier may be appropriately adjusted by controlling the composition of the coating resin for the coating resin layer or by changing the additives added to the coating resin.

The resin-coated carrier preferably has a volume-average particle diameter of 15 to 80 μm, preferably 20 to 60 μm, more preferably 20 to 50 μm. The particles having the volume-average particle diameter ±10 μm account for not less than 50% by weight, preferably not less than 65% by weight, more preferably not less than 80% by weight of all the carrier particles. When the volume-average particle diameter is less than 15 μm, the resin-coated carrier is likely to adhere to a photosensitive material to cause image defects such as white spots. When the volume-average particle diameter is above 80 μm, the carrier has a small surface area and the charging capability tends to be lowered.

The resin-coated carrier generally has a true specific gravity of 1.5 to 4.0, preferably 2.0 to 3.8, more preferably 2.2 to 3.7. When the true specific gravity is less than 1.5, the rate of charge building is low and the toner scattering or fog occurs easily. When the true specific gravity is above 4.0, the stress within a developing device is increased and preventing the toner-spent becomes difficult.

The resin-coated carrier generally ranges in bulk density from 0.8 to 2.5 g/cm$^3$, preferably from 0.9 to 2.2 g/cm$^3$, more preferably from 1.0 to 2.0 g/cm$^3$. This range of bulk density is lower than that of conventional iron powder carriers or ferrite carriers, and therefore permits weight reduction of the carrier for electrophotographic developer and prevention of toner-spent, enabling high-quality images.

The shape coefficient of the resin-coated carrier is generally in the range of 1.0 to 2.5, preferably 1.0 to 2.0, particularly preferably 1.0 to 1.8. When the shape coefficient is above 2.5, the resin-coated carrier may be deteriorated in fluidity and cannot be homogeneously mixed and stirred with the toner particles, possibly leading to deteriorated charging properties.

The resin-coated carrier generally has a magnetization at 5000 k/4π·A/m (5 kOe) of 30 to 90 Am$^2$/kg (emu/g), preferably 35 to 80 Am$^2$/kg (emu/g), more preferably 50 to 75 Am$^2$/kg (emu/g). When the magnetization is less than 30 Am$^2$/kg (emu/g), adhesion of the carrier occurs easily. When the magnetization is above 90 Am$^2$/kg (emu/g), the magnetic brushes become so hard that the image quality tends to be lowered.

The resin-coated carrier preferably has a resistance at 5000 V/cm electric field of $10^4$ to $10^{13}$ Ω, more preferably $10^5$ to $10^{12}$ Ω. When the resistance is less than $10^4$ Ω, the electric charge leaks easily and image defects such as brush marks or white spots tend to occur in solid parts. When the resistance is above $10^{13}$ Ω, it is difficult to obtain the desired image density.

In the present invention, the properties evaluated were determined by the following methods.

(Volume-average Particle Diameter)

The volume-average particle diameter of the resin-coated carrier was measured using a laser diffraction/scattering particle size distribution analyzer (LS-230, manufactured by Beckman-Coulter, Inc.).

(Magnetic Properties)

The magnetic properties of the resin-coated carrier were determined by measuring a magnetization at an applied magnetic field of 5000 k/4π·A/m (5 kOe) using an oscillation magnetometer (VSM-5-18, manufactured by Toei Industry Co., Ltd.).

(True Specific Gravity and Bulk Density)

The true specific gravity of the resin-coated carrier was measured using a pycnometer in accordance with JIS R 9301-2-1. The bulk density of the carrier particles was measured in accordance with JIS Z 2504.

(Shape Observation)

The shape of the resin-coated carrier was identified by observation using a scanning electron microscope (JSM-6100, manufactured by JEOL Ltd.).

(Shape Coefficient)

To determine the shape coefficient of the resin-coated carrier, an image of the carrier particle was taken by means of a scanning electron microscope, and the image was analyzed with an image analysis software (Image-Pro Plus, manufactured by Media Cybernetics), followed by calculation. The shape coefficient was represented by the following formula (1), and was determined for each particle. The shape coefficient is an average of the shape coefficients of one hundred resin-coated carrier particles.

$$\text{Shape coefficient} = \text{Largest diameter}/\text{Smallest diameter} \quad (1)$$

In the formula (1), the largest diameter means the longest straight line which links two points on the outer circumference of a particle through the center of gravity thereof, and the smallest diameter refers to the shortest straight line which links two points on the outer circumference of a particle through the center of gravity thereof.

(Charging Properties)

A carrier-toner mixture was measured for charge quantity using a suction-type charge quantity meter (q/m-meter, manufactured by Epping GmbH PES-Laboratorium).

(Electrical Resistance)

An N pole and an S pole were opposed to each other with a distance of 2.0 mm therebetween. 200 mg of a sample was weighed and placed on a nonmagnetic flat electrode (10 mm×40 mm) arranged parallel to the poles. A magnetic pole (surface magnetic flux density: 1500 Gauss, counter electrode area: 10 mm×30 mm) was placed on the flat electrode and the sample was held between the electrodes. The electrical resistance at an applied voltage of 1000 V was measured with an insulation-resistance meter (SM-8210, manufactured by DKK-TOA Co.).

(Viscosity)

The viscosity of the binder resin raw materials was measured using a vibration viscometer (VM-1G, manufactured by Yamaichi Electronics Co., Ltd.)

(Change in Specific Gravity)

A mixture of the polysiloxane compound (A) and the polysiloxane compound (B) was placed in a measuring flask, and the weight thereof per cm$^3$ was obtained as a specific gravity before heating. Subsequently, the mixture was heated at 120° C. for 5 hours to give a cured product. The cured product was sufficiently pulverized, and the specific gravity thereof was measured with a pycnometer as a specific gravity after heating. The change in specific gravity was determined by the following formula (2).

$$\text{Change in specific gravity} = \text{Specific gravity after heating}/\text{Specific gravity before heating} \quad (2)$$

(Amount of By-products Generated)

The binder resin raw materials were mixed together, and 100 g of the mixture was heated from ordinary temperature to 120° C. at a rate of 2° C./min. The heated binder resin was weighed, and the weight reduction was ascribed to the by-products generated (parts by weight).

(Two-component Developer)

The two-component developer of the invention comprises the above resin-coated carrier particles and toner particles. The toner particles for use in the invention include ground toner particles prepared by grinding, and polymerized toner particles produced by polymerization. The invention may employ toner particles obtained by any of these methods.

The ground toner particles may be prepared, for example, by sufficiently kneading a composition containing a binder resin, a charge controlling agent and a coloring agent with a kneading apparatus such as Henschel mixer; melt-kneading the kneadate with a twin-screw extruder or the like; then cooling and grinding the kneadate; classifying the particles; adding an external additive; and mixing with a mixer or the like. The shape and properties may be controlled by performing heat treatment or chemical liquid treatment as required.

The binder resin for constituting the toner particles is not particularly limited, and examples thereof include polystyrene, polychlorostyrene, styrene/chlorostyrene copolymer, styrene/acrylate copolymer, styrene/methacrylate copolymer, rosin-modified maleic resin, epoxy resin, polyester resin and polyurethane resin.

The charge controlling agent may be arbitrary and is not particularly limited. For example, the charge controlling agents for positively charged toners include nigrosine dyes and quaternary ammonium salt compounds, and for negatively charged toners include metal-containing monoazo and diazo dyes.

The coloring agent (colorant) used herein may be a dye and/or a pigment conventionally known. Examples thereof include carbon black, phthalocyanine blue, permanent red, chrome yellow and phthalocyanine green. Furthermore, external additives such as silica powder and titania may be added as required to improve the fluidity and aggregation resistance of the toner.

The polymerized toner particles are prepared by known methods such as suspension polymerization, emulsion polymerization, emulsion polymerization aggregation, phase transition emulsification and ester elongation polymerization. Specifically, the polymerized toner particles may be prepared as follows. First, a colored dispersion in which a coloring agent is dispersed in water by use of a surface-active agent is stirred and mixed with a polymerizable monomer, a surface-active agent and a polymerization initiator in an aqueous medium to emulsify and disperse the polymerizable monomer in the aqueous medium. The polymerizable monomer is polymerized with stirring and mixing, and the polymer particles are salted out, filtered, washed and dried. Subsequently, the external additive is added to the dry polymerized toner particles as required.

In preparing the polymerized toner particles, a fixing property improver and a charge controlling agent may be added in addition to the polymerizable monomer, surface-active agent, polymerization initiator and coloring agent. Furthermore, a chain transfer agent may be used in order to improve the dispersibility of the polymerizable monomer in the aqueous medium and to adjust the molecular weight of the polymer obtained.

The polymerizable monomer used for preparing the polymerized toner particles is not particularly limited, and example thereof include styrene and derivatives thereof; ethylenically unsaturated monoolefins such as ethylene and propylene; vinyl halides such as vinyl chloride; vinyl esters such as vinyl acetate; and α-methylene aliphatic monocarboxylates such as methyl acrylate, ethyl acrylate, methyl methacrylate, ethyl methacrylate, 2-ethylhexyl methacrylate, dimethylamino acrylate and diethylamino methacrylate.

The coloring agent (colorant) used in preparing the polymerized toner particles may be a known dye and/or pigment. Examples thereof include carbon black, phthalocyanine blue, permanent red, chrome yellow and phthalocyanine green. The coloring agents may be surface modified with surface modifiers such as silane-coupling agents and titanate-coupling agents.

Examples of the surface-active agents used in preparing the polymerized toner particles include anionic surface-active agents, cationic surface-active agents, amphoteric surface-active agents and nonionic surface-active agents.

Examples of the anionic surface-active agents include fatty acid salts such as sodium oleate and castor oil; alkyl sulfate esters such as sodium lauryl sulfate and ammonium lauryl sulfate; alkylbenzene sulfonates such as sodium dodecylbenzenesulfonate; alkylnaphthalene sulfonates; alkyl phosphates; naphthalene sulfonic acid-formalin condensates and polyoxyethylene alkyl sulfates. Examples of the cationic surface-active agents include alkylamine salts such as laurylamine acetate; and quaternary ammonium salts such as lauryl trimethyl ammonium chloride and stearyl trimethyl ammonium chloride. Examples of the amphoteric surface-active agents include aminocarboxylates and alkylamino acids. Examples of the nonionic surface-active agents include polyoxyethylene alkyl ethers, polyoxyethylene fatty acid esters, sorbitan fatty acid esters, polyoxyethylene alkyl amines, glycerins, fatty acid esters and oxyethylene/oxypropylene copolymers. The surface-active agents having a polymerizable vinyl group in the structure are also favorable.

The surface-active agent may be generally used in an amount of 0.01 to 10% by weight based on the polymerizable monomer. The amount in which the surface-active agent is added affects the dispersing stability of the monomer and also the environmental dependency of the resulting polymerized toner particles. Therefore, the surface-active agent is preferably used in an amount that ensures the dispersing stability of the monomer and does not influence excessively the environmental dependency of the polymerized toner particles.

The preparation of the polymerized toner particles generally involves a polymerization initiator. Examples of the polymerization initiators include water-soluble polymerization initiators and oil-soluble polymerization initiators. The invention may employ any of the initiators. The water-soluble polymerization initiators usable in the invention include persulfates such as potassium persulfate and ammonium persulfate; and water-soluble peroxide compounds. The oil-soluble polymerization initiators include azo compounds such as azobisisobutyronitrile; and oil-soluble peroxide compounds.

Examples of the chain transfer agents optionally used in the invention include mercaptans such as octyl mercaptan, dodecyl mercaptan and tert-dodecyl mercaptan; and carbon tetrabromide.

Examples of the fixing property improvers optionally used in preparing the polymerized toner particles include natural waxes such as carnauba wax; and olefin waxes such as polypropylene and polyethylene.

The charge controlling agents optionally used in preparing the polymerized toner particles are not particularly limited and include nigrosine dyes, quaternary ammonium salts, organic metal complexes and metal-containing monoazo dyes.

Examples of the external additives used for improving the fluidity and aggregation resistance of the polymerized toner particles include silica powder, titania, barium titanate, fluororesin fine particles and acrylic resin fine particles. These may be used singly or in combination.

Examples of salting out agents used for separating the polymerized particles from the aqueous medium in the preparation of the polymerized toner include metal salts such as magnesium sulfate, aluminum sulfate, barium chloride, magnesium chloride, calcium chloride and sodium chloride.

The toner particles prepared as described above have a volume-average particle diameter in the range of 3 to 15 μm, preferably 4 to 10 μm. When the volume-average particle diameter is less than 3 μm, the toner particles show a lower capability of being charged and easily cause fog and toner scattering. The volume-average particle diameter exceeding 15 μm can invite poor image quality. The toner particles that constitute a developer in combination with the carrier particles of the present invention are preferably the polymerized toner particles. The polymerized toner particles possess a narrow particle size distribution width, high particle uniformity, and a narrow charge quantity distribution. Such toner particles in combination with the carrier particles of the invention can provide a developer having higher fluidity, and high-quality images can be easily obtained.

The electrophotographic developer of the present invention may be obtained by mixing the resin-coated carrier and the toner particles. The concentration of the toner particles in the developer, namely, the toner concentration is preferably adjusted in the range of 5 to 15%. The desired image density is difficult to attain when the toner concentration is less than 5%. The concentration exceeding 15% tends to result in toner scattering and fog.

The two-component electrophotographic developer according to the present invention has a good charge build up of toner, is resistant to toner-spent even in long-term use, and can maintain the charge quantity stably. That is, the two-component electrophotographic developer has a high rate of toner charge building, does not cause toner-spent even when stirred for a long period of time, and maintains a stable charge quantity. The developer preferably has a change in charge quantity represented by a ratio of the charge quantity after 600 minutes to the charge quantity after 1 minute, in the range of 0.75 to 1.5. The two-component electrophotographic developer possesses excellent environmental stability. Specifically, the ratio of the charge quantity at a low temperature and a low humidity (10° C., 15% RH) to the charge quantity at a high temperature and a high humidity (35° C., 85% RH) (low-temperature and humidity charge quantity/high-temperature and humidity charge quantity) is preferably not more than 1.45.

EFFECT OF THE INVENTION

In the carrier for electrophotographic developer of the invention, the functional group (s) in the coating resin layer and the functional group (c) of the binder resin in the carrier core are chemically reacted such that the binder resin in the carrier core and the coating resin layer are joined by direct chemical bonds, which are so strong that the separation of the coating resin layer from the core is unlikely even in long-term use. The carrier for electrophotographic developer has a smooth surface, very small particle-size distribution width and excellent flowability to display superior toner-charging capability. Furthermore, the carrier includes very little by-products such as water and alcohol, and has small changes in specific gravity and weight before and after heating, so that voids or cracks are prevented from occurring in the resin-coated carrier, achieving high durability.

The carrier for electrophotographic developer of the invention is free of exposure of the magnetic powder on the surface of the resin-coated carrier, has reduced possibility of release of the magnetic powder or contamination of the carrier particles with the toner, and is unlikely to cause a damaged drum or defective images such as blushing.

Moreover, the invention does not limit the coating resins to resins formed from radically polymerizable monomers, and thereby permits a wide range of designing freedom to satisfy carrier properties required and makes it possible to cope with varied requirements for the carrier properties.

EXAMPLES

The present invention will be hereinafter described in greater detail by Examples, but it should be construed that the invention is in no way limited to such Examples.

(Preparation of Carrier Core)

Core Preparation Example 1

In a kneader, 17.74 parts by weight of an epoxy group-containing polysiloxane compound (A-1) having an epoxy equivalent weight of 550 g/mol, 7.97 parts by weight of an amino group-containing polysiloxane compound (B-1) having an amino equivalent weight of 360 g/mol, 75 parts by weight of magnetite fine particles, and 0.69 part by weight of γ-aminopropyltrimethoxysilane were sufficiently kneaded to give a paste.

1 part by weight of calcium phosphate and 9 parts by weight of ion exchange water were mixed and vigorously stirred to give a suspended dispersion medium. To 10 parts by weight of the suspended dispersion medium, 3 parts by weight of the above-prepared paste was added with stirring by a homogenizer, followed by stirring for 5 minutes. The resultant suspension was heated at 85° C. with stirring for 10 hours and was cooled to 25° C. Subsequently, hydrochloric acid was added to dissolve calcium phosphate, and solid-liquid separation was performed. The solid was washed and then dried, and was thermally cured at 170° C. for 5 hours and pulverized to provide an epoxy group-containing carrier core (i).

Core Preparation Example 2

An amino group-containing carrier core (ii) was prepared in the same manner as in Core Preparation Example 1, except that the amount of the epoxy group-containing polysiloxane compound (A-1) was changed from 17.74 parts by weight to 12.04 parts by weight, the amount of the amino group-containing polysiloxane compound (B-1) was changed from 7.97 parts by weight to 10.81 parts by weight, and the amount of γ-aminopropyltrimethoxysilane was changed from 0.69 part by weight to 0.70 part by weight.

Core Preparation Example 3

A paste was prepared in the same manner as in Core Preparation Example 1, except that the amount of the epoxy group-containing polysiloxane compound (A-1) was changed from 17.74 parts by weight to 15.01 parts by weight, the amount of the amino group-containing polysiloxane compound (B-1) was changed from 7.97 parts by weight to 9.67 parts by weight, and the amount of γ-aminopropyltrimethoxysilane was changed from 0.69 part by weight to 0.79 part by weight.

To 10 parts by weight of a suspended dispersion medium prepared as described in Core Preparation Example 1, 3 parts by weight of the paste was added with stirring by a homogenizer, followed by stirring for 5 minutes. A carrier core (iii) containing equal amounts of an epoxy group and an amino group was prepared in the same manner as in Core Preparation Example 1, except that the resultant suspension was heated at 85° C. with stirring for 5 hours, and a solid was thermally cured at 120° C. for 2 hours.

Core Preparation Example 4

In a kneader, 100 parts by weight of a de-alcohol curing straight silicone resin (SR-2401P, manufactured by Toray Dow Corning Silicone Co., Ltd.), 17 parts by weight of γ-aminopropyltrimethoxysilane, 400 parts by weight of magnetite fine particles, and 4 parts by weight of dibutyltin laurate as curing catalyst were sufficiently kneaded to give a paste. A carrier core (a) was prepared in the same manner as in Core Preparation Example 1 using this paste.

Core Preparation Example 5

A reactor was charged with 16.5 parts by weight of phenol, 258 parts by weight of 37% formalin, 1000 parts by weight of magnetite fine particles that had been surface-modified with 5.0 parts by weight of an epoxy group-containing silane-coupling agent, 32 parts by weight of 29 wt % ammonia water, and 30 parts by weight of water. The mixture liquid was heated from room temperature to 85° C. over a period of 60 minutes with stirring, and reaction was carried out for another 3 hours. The resultant reaction liquid was cooled naturally, and solid-liquid separation was performed. The solid was washed and then dried, and a carrier core (b) was obtained.

Coating Resin Preparation Example 1

0.6 part by weight of the epoxy group-containing polysiloxane compound (A-1) used in Core Preparation Example 1, 0.9 part by weight of the amino group-containing polysiloxane compound (B-1) used in Core Preparation Example 1, and 13.5 parts by weight of toluene were mixed together to give a toluene solution of a coating resin (i) having an epoxy group/amino group ratio (functional group content ratio) of 0.43.

Coating Resin Preparation Example 2

A toluene solution of an epoxy group-containing coating resin (ii) was prepared in the same manner as in Coating Resin Preparation Example 1, except that the amount of the epoxy group-containing polysiloxane compound (A-1) was changed from 0.6 part by weight to 1.2 parts by weight, and the amount of the amino group-containing polysiloxane compound (B-1) was changed from 0.9 part by weight to 0.3 part by weight. The epoxy group/amino group ratio (functional group content ratio) of the coating resin (ii) was 2.62.

Coating Resin Preparation Example 3

A toluene solution of a coating resin (iii) was prepared in the same manner as in Coating Resin Preparation Example 1, except that the amount of the epoxy group-containing polysiloxane compound (A-1) was changed from 0.6 part by weight to 0.91 part by weight, and the amount of the amino group-containing polysiloxane compound (B-1) was changed from 0.9 part by weight to 0.59 part by weight. The resin contained equal amounts of an epoxy group and an amino group, that is, the epoxy group/amino group ratio (functional group content ratio) was 1.00.

Coating Resin Preparation Example 4

A toluene solution of a coating resin (iv) was prepared in the same manner as in Coating Resin Preparation Example 1, except that the amount of the epoxy group-containing polysiloxane compound (A-1) was changed from 0.6 part by weight to 0.35 part by weight, and the amount of the amino group-containing polysiloxane compound (B-1) was changed from 0.9 part by weight to 1.09 parts by weight. The epoxy group/amino group ratio (functional group content ratio) of the coating resin (iv) was 0.200.

Preparation Examples of Resin-coated Carriers

Example 1

A kneader equipped with a PID-controlled heater was provided, and a stirring tank of the kneader was charged with 100 parts by weight of the epoxy group-containing carrier core (i), and 1.5 parts by weight in terms of solid resin of the toluene solution of the amino group-containing coating resin (i). They were gradually heated to 175° C. while being sufficiently stirred, and was maintained for 5 hours. Resin-coated carrier particles 1 were thus obtained.

Example 2

Resin-coated carrier particles 2 were obtained in the same manner as in Example 1, except that the epoxy group-containing carrier core (i) was replaced with 100 parts by weight of the amino group-containing carrier core (ii), and that the toluene solution of the amino group-containing coating resin (i) was replaced with 1.5 parts by weight in terms of solid resin of the toluene solution of the epoxy group-containing coating resin (ii).

Example 3

Resin-coated carrier particles 3 were obtained in the same manner as in Example 1, except that the epoxy group-containing carrier core (i) was replaced with 100 parts by weight of the carrier core (iii) containing equal amounts of an epoxy group and an amino group, and that the toluene solution of the amino group-containing coating resin (i) was replaced with 1.5 parts by weight in terms of solid resin of the toluene solution of the coating resin (iii) containing equal amounts of an epoxy group and an amino group.

Example 4

Resin-coated carrier particles 4 were obtained in the same manner as in Example 3, except that the toluene solution of the coating resin (iii) containing equal amounts of an epoxy group and an amino group was replaced with 1.5 parts by weight in terms of solid resin of the toluene solution of the coating resin (iv) containing an epoxy group and an amino group in 1:5 ratio.

Example 5

Resin-coated carrier particles 5 were obtained in the same manner as in Example 3, except that the toluene solution of the amino group-containing coating resin (i) was combined with 5.0 parts by weight (relative to the solid content of the coating resin) of a fluorine-containing silane-coupling agent (TSL 8233, manufactured by GE Toshiba Silicones).

Comparative Example 1

Resin-coated carrier particles 6 were obtained in the same manner as in Example 1, except that the toluene solution of the amino group-containing coating resin (i) was replaced with 1.5 parts by weight in terms of solid resin of a coating resin material obtained by diluting methyl silicone resin (SR-2411, manufactured by Toray Dow Corning Silicone Co., Ltd.) with toluene to a 10 wt % solid concentration.

Comparative Example 2

Resin-coated carrier particles 7 were obtained in the same manner as in Example 1, except that the epoxy group-containing carrier core (i) was replaced with 100 parts by weight of the carrier core (a), and that the toluene solution of the amino group-containing coating resin (i) was replaced with 1.5 parts by weight in terms of solid resin of the toluene solution of the coating resin (iii) containing equal amounts of an epoxy group and an amino group.

Comparative Example 3

Resin-coated carrier particles 8 were obtained in the same manner as in Comparative Example 1, except that the carrier core (i) was replaced with 100 parts by weight of the carrier core (b), and that the coating resin material was obtained by diluting 10 parts by weight of methyl silicone resin (SR-2411, manufactured by Toray Dow Corning Silicone Co., Ltd.) with toluene to a 10 wt % solid concentration and adding 0.02 part by weight of γ-aminopropyltrimethoxysilane.

Properties obtained in Examples and Comparative Examples are shown in Table 1.

TABLE 1

| | Volume average particle diameter [μm] | Content of particles having volume average particle diameter ± 10 μm [%] | True specific gravity [g/cm$^3$] | Bulk density [g/cm$^3$] | Magneti-zation [emu/g] | Resistance [Ω (250 V)] | Shape coefficient | Change in specific gravity | By-product amount |
|---|---|---|---|---|---|---|---|---|---|
| Ex. 1 | 35.2 | 82.3 | 2.86 | 1.40 | 69 | 1.2E + 11 | 1.10 | 1.09 | 7.2 |
| Ex. 2 | 34.4 | 80.2 | 2.85 | 1.49 | 69 | 2.3E + 11 | 1.09 | 1.11 | 8.6 |
| Ex. 3 | 34.8 | 84.3 | 2.98 | 1.56 | 70 | 3.8E + 10 | 1.08 | 1.10 | 8.5 |
| Ex. 4 | 34.7 | 81.2 | 2.86 | 1.36 | 70 | 2.1E + 11 | 1.16 | 1.09 | 8.3 |
| Ex. 5 | 36.8 | 80.5 | 2.89 | 1.25 | 70 | 2.5E + 11 | 1.12 | 1.13 | 8.6 |
| Comp. Ex. 1 | 36.2 | 72.5 | 2.81 | 1.42 | 70 | 2.8E + 11 | 1.10 | 1.08 | 8.9 |
| Comp. Ex. 2 | 33.8 | 60.5 | 2.15 | 0.98 | 70 | 1.8E + 10 | 1.18 | 1.33 | 21.1 |
| Comp. Ex. 3 | 34.6 | 61.3 | 3.57 | 1.82 | 68 | 1.2E + 10 | 1.04 | — | — |

Note
"—" indicates that the measurement was impossible.

(Evaluation of Durability of Resin-coated Carrier)

30 g of the resin-coated carrier particles were placed in a 50-ml closed glass vessel and shaken with an amplitude of cm and at a frequency of 10.0 Hz for 5 minutes, 30 minutes, 60 minutes, 120 minutes and 300 minutes. Before the shaking and after the shaking for each predetermined time, the resin-coated carrier was plated with gold and encapsulated in an epoxy resin. The resin-coated carrier was cut with a microtome to expose its cross section, and the carrier core and the coating layer were recorded with a scanning electron microscope (JSM-6100, manufactured by JEOL Ltd.). The SEM image was digitally scanned. One hundred coating resin layers were analyzed for cross sectional area by means of an image analysis software (Image-Pro Plus, manufactured by Media Cybernetics), and the total S of the cross sectional areas was obtained. The durability of the resin-coated carrier was evaluated by calculating the change of cross sectional area before and after shaking for the predetermined time, using the following formula (3):

$$\text{Change of cross sectional area of coating layer} = Ss/Si \quad (3)$$

wherein Si is the total cross sectional area of 100 coating resin layers of the resin-coated carriers as determined before shaking, and Ss is the total cross sectional area of 100 coating resin layers of the resin-coated carriers as determined after each predetermined time of shaking.

Table 2 shows the results of the durability evaluation of the resin-coated carriers prepared in Examples 1 to 5 and Comparative Examples 1 to 3.

TABLE 2

| | | Shaking time | | | | |
|---|---|---|---|---|---|---|
| | | 5 min | 30 min | 60 min | 120 min | 300 min |
| Ex. 1 | Carrier 1 | 0.98 | 0.95 | 0.92 | 0.85 | 0.82 |
| Ex. 2 | Carrier 2 | 0.97 | 0.92 | 0.93 | 0.82 | 0.83 |
| Ex. 3 | Carrier 3 | 0.98 | 0.97 | 0.95 | 0.96 | 0.88 |
| Ex. 4 | Carrier 4 | 0.96 | 0.91 | 0.84 | 0.82 | 0.80 |
| Ex. 5 | Carrier 5 | 0.98 | 0.97 | 0.91 | 0.90 | 0.86 |
| Comp. Ex. 1 | Carrier 6 | 0.90 | 0.81 | 0.79 | 0.74 | 0.69 |
| Comp. Ex. 2 | Carrier 7 | 0.82 | 0.72 | 0.69 | 0.46 | 0.21 |

TABLE 2-continued

| | | Shaking time | | | | |
|---|---|---|---|---|---|---|
| | | 5 min | 30 min | 60 min | 120 min | 300 min |
| Comp. Ex. 3 | Carrier 8 | 0.91 | 0.90 | 0.82 | 0.70 | 0.63 |

The above results prove high coating durability of the carriers obtained in Examples according to the present invention. These favorable results were probably achieved by the binder resin of the carrier core and the coating resin layer being joined by chemical bonds. The SEM observation revealed that some of the resin-coated carriers of Comparative Example 2 had been broken or cracked after shaken for 300 minutes.

(Evaluation of Contamination Resistance (Toner-spent Resistance) of Resin-coated Carrier)

A 50-ml closed glass vessel was charged with 18.5 g of the resin-coated carrier particles and 1.5 g of a black toner (polyester toner, volume-average particle diameter: 5.66 μm) for commercial machine (imagio NEO351, manufactured by Ricoh Company, Ltd.), and the vessel was closed. The vessel was then held in a shaker mixer (TURBURA T2F, manufactured by Willy A. Bachofen AG Maschinenfabrik) and shaken at 90 rpm. After shaking for a predetermined time, the resin-coated carrier/toner mixture was placed on a 20 μm-aperture stainless steel mesh and the toner alone was removed by suction at 2.0 kgf/cm$^2$. After the toner had been suction removed, 15 g of the resin-coated carrier and 30 ml of toluene were introduced in a 50-ml closed glass vessel and the vessel was shaken for 5 minutes with a paint shaker. The supernatant liquid was collected and was measured for transmittance T of white light with an absorption spectrophotometer (6100 model spectrophotometer, manufactured by JENWAY), and the turbidity At was determined by the following formula (4):

$$\text{Turbidity At} = -\text{Log}T \quad (4)$$

wherein T is the white light transmittance of the toluene supernatant liquid.

The turbidity values At were used to evaluate the resin-coated carriers for resistance to contamination with the toner. The results are shown in Table 3.

TABLE 3

| | | Shaking time | | | | |
|---|---|---|---|---|---|---|
| | | 5 min | 30 min | 60 min | 120 min | 300 min |
| Ex. 1 | Carrier 1 | 0.013 | 0.015 | 0.014 | 0.021 | 0.030 |
| Ex. 2 | Carrier 2 | 0.017 | 0.013 | 0.016 | 0.021 | 0.025 |
| Ex. 3 | Carrier 3 | 0.012 | 0.010 | 0.014 | 0.016 | 0.022 |
| Ex. 4 | Carrier 4 | 0.015 | 0.015 | 0.021 | 0.038 | 0.041 |
| Ex. 5 | Carrier 5 | 0.021 | 0.023 | 0.031 | 0.050 | 0.059 |
| Comp. Ex. 1 | Carrier 6 | 0.057 | 0.052 | 0.059 | 0.064 | 0.069 |
| Comp. Ex. 2 | Carrier 7 | 0.032 | 0.031 | 0.031 | 0.062 | 0.186 |
| Comp. Ex. 3 | Carrier 8 | 0.091 | 0.072 | 0.092 | 0.152 | 0.161 |

The above results prove high contamination resistance of the carrier particles 1 to 5 obtained in Examples according to the present invention. The carrier of Comparative Example 1 in which the carrier core was the silicone resin cured by ring-opening addition reaction showed relatively good contamination resistance, although the coating durability evaluation thereof resulted in separation of the coating layer. The carrier of Comparative Example 2 had serious contamination after shaken for 300 minutes, probably with the toner composition. After the evaluation, an electron microscopic picture of the carrier particles of Comparative Example 3 was taken for surface observation, which revealed separation of the coating layer, exposed carrier core surface, and contamination of the exposed surface with the toner composition.

(Evaluation of Developer Durability by Measuring Charge Quantity)

A 50-ml closed glass vessel was charged with 18.5 parts by weight of the resin-coated carrier particles and 1.5 parts by weight of a black toner (polyester toner, volume-average particle diameter: 5.66 μm) for commercial machine (imagio NEO351, manufactured by Ricoh Company, Ltd.), and the vessel was closed. The vessel was then held in a shaker mixer (TURBURA T2F, manufactured by Willy A. Bachofen AG Maschinenfabrik) and shaken at 90 rpm. Sampling was performed after each predetermined time, and the charge quantity of the sample was measured at ordinary temperature and humidity (23° C. and 55% RH) using a suction-type charge quantity meter (q/m-meter, manufactured by Epping GmbH PES-Laboratorium). The change of charge quantity with the shaking time was obtained as standard signal-to-noise (SN) ratio to evaluate the developer durability. The results are shown in Table 4.

TABLE 4

| | | Charge quantity [μc/g] | | | | | Standard SN ratio at charge quantity [db] |
|---|---|---|---|---|---|---|---|
| | | 1 min | 5 min | 30 min | 60 min | 300 min | |
| Ex. 1 | Carrier 1 | 28.1 | 29.0 | 30.2 | 31.0 | 30.3 | 28.20 |
| Ex. 2 | Carrier 2 | 10.2 | 11.0 | 11.5 | 12.0 | 10.3 | 23.08 |
| Ex. 3 | Carrier 3 | 16.6 | 16.0 | 16.0 | 16.5 | 15.3 | 29.86 |
| Ex. 4 | Carrier 4 | 32.5 | 33.6 | 35.4 | 34.8 | 30.1 | 24.00 |
| Ex. 5 | Carrier 5 | 16.8 | 15.9 | 15.0 | 15.8 | 14.8 | 25.85 |
| Comp. Ex. 1 | Carrier 6 | 18.1 | 20.5 | 21.0 | 16.2 | 11.6 | 13.19 |
| Comp. Ex. 2 | Carrier 7 | 16.5 | 15.8 | 12.9 | 13.8 | 8.6 | 12.71 |
| Comp. Ex. 3 | Carrier 8 | 6.8 | 7.2 | 6.8 | 4.2 | 3.8 | 10.94 |

The above results prove that the carrier particles 1 to 5 obtained in Examples had good charge retention properties, with small changes in charge quantity throughout 300 minutes of shaking. The Comparative Example carrier particles that showed great changes in the coating durability evaluation and contamination resistance evaluation had great changes in charge quantity with the shaking time. This result will indicate that the coating separation or toner contamination led to lower charge retention properties. In particular, the carrier of Comparative Example 3 having the phenolic resin core showed greater changes of charge quantity, probably because the separation of the coating resin layer had exposed the core surface and consequently the carrier had been seriously contaminated with the toner composition.

The resin-coated carrier according to the present invention is free of separation of the coating resin layer and release of the magnetic powder, has excellent mechanical strength, durability and environmental stability, can prevent the occurrence of toner-spent, and exhibits good flowability and superior toner charging capability. Therefore, it can be suitably used in electrophotographic developers. The developers containing the carrier of the invention can provide high quality images.

The invention claimed is:

1. A carrier for electrophotographic developer comprising a resin carrier core comprising a binder resin and magnetic powder dispersed in the binder resin, and a coating layer comprising a coating resin on a surface of the core, the binder resin being a silicone resin obtained by curing of a polysiloxane compound (A) having an epoxy group and a polysiloxane compound (B) having a functional group (b) capable of reacting with the epoxy group, due to a ring-opening addition reaction;

the silicone resin containing at least one functional group (c) selected from the group consisting of an epoxy group derived from the polysiloxane compound (A) and a functional group (b) derived from the polysiloxane compound (B);

the coating resin containing at least one functional group (s) selected from the group consisting of an epoxy group and a functional group (d) capable of reacting with an epoxy group;

the functional group (c) and the functional group (s) forming a chemical bond.

2. The carrier for electrophotographic developer according to claim 1, wherein the functional group (c) is an epoxy group, and the functional group (s) is a functional group (d) capable of reacting with an epoxy group.

3. The carrier for electrophotographic developer according to claim 1, wherein the functional group (c) is a functional group (b) capable of reacting with an epoxy group, and the functional group (s) is an epoxy group.

4. The carrier for electrophotographic developer according to claim 1, wherein the functional groups (b) and (d) capable of reacting with an epoxy group are each at least one functional group selected from the group consisting of an amino group, a carboxyl group, a mercapto group and a carbinol group.

5. The carrier for electrophotographic developer according to claim 1, wherein the functional groups (b) and (d) capable of reacting with an epoxy group are each an amino group.

6. The carrier for electrophotographic developer according to claim 1, wherein the coating resin is at least one resin selected from the group consisting of a silicone resin, a modified silicone resin and a modified acrylic resin.

7. The carrier for electrophotographic developer according to claim 1, wherein the coating resin contains a fluorine atom.

8. The carrier for electrophotographic developer according to claim 1, wherein the resin carrier core is obtained by mixing at least the polysiloxane compound (A), the polysiloxane compound (B) and magnetic powder, suspending the mixture in an aqueous medium, and curing.

9. A two-component electrophotographic developer comprising the carrier for electrophotographic developer as claimed in claim 1, and toner particles having a volume-average particle diameter in the range of 3 to 15 μm.

10. The carrier for electrophotographic developer according to claim 2, wherein the functional groups (b) and (d) capable of reacting with an epoxy group are each at least one functional group selected from the group consisting of an amino group, a carboxyl group, a mercapto group and a carbinol group.

11. The carrier for electrophotographic developer according to claim 3, wherein the functional groups (b) and (d) capable of reacting with an epoxy group are each at least one functional group selected from the group consisting of an amino group, a carboxyl group, a mercapto group and a carbinol group.

12. The carrier for electrophotographic developer according to claim 2, wherein the functional groups (b) and (d) capable of reacting with an epoxy group are each an amino group.

13. The carrier for electrophotographic developer according to claim 3, wherein the functional groups (b) and (d) capable of reacting with an epoxy group are each an amino group.

14. The carrier for electrophotographic developer according to claim 4, wherein the functional groups (b) and (d) capable of reacting with an epoxy group are each an amino group.

15. The carrier for electrophotographic developer according to claim 2, wherein the coating resin is at least one resin selected from the group consisting of a silicone resin, a modified silicone resin and a modified acrylic resin.

16. The carrier for electrophotographic developer according to claim 3, wherein the coating resin is at least one resin selected from the group consisting of a silicone resin, a modified silicone resin and a modified acrylic resin.

17. The carrier for electrophotographic developer according to claim 4, wherein the coating resin is at least one resin selected from the group consisting of a silicone resin, a modified silicone resin and a modified acrylic resin.

18. The carrier for electrophotographic developer according to claim 5, wherein the coating resin is at least one resin selected from the group consisting of a silicone resin, a modified silicone resin and a modified acrylic resin.

19. The carrier for electrophotographic developer according to claim 2, wherein the coating resin contains a fluorine atom.

20. The carrier for electrophotographic developer according to claim 3, wherein the coating resin contains a fluorine atom.

21. The carrier for electrophotographic developer according to claim 2, wherein the resin carrier core is obtained by mixing at least the polysiloxane compound (A), the polysiloxane compound (B) and magnetic powder, suspending the mixture in an aqueous medium, and curing.

22. The carrier for electrophotographic developer according to claim 3, wherein the resin carrier core is obtained by mixing at least the polysiloxane compound (A), the polysiloxane compound (B) and magnetic powder, suspending the mixture in an aqueous medium, and curing.

23. A two-component electrophotographic developer comprising the carrier for electrophotographic developer as claimed in claim 2, and toner particles having a volume-average particle diameter in the range of 3 to 15 μm.

24. A two-component electrophotographic developer comprising the carrier for electrophotographic developer as claimed in claim 3, and toner particles having a volume-average particle diameter in the range of 3 to 15 μm.

25. A two-component electrophotographic developer comprising the carrier for electrophotographic developer as claimed in claim 4, and toner particles having a volume-average particle diameter in the range of 3 to 15 μm.

* * * * *